US009067651B1

(12) United States Patent
Peterson

(10) Patent No.: US 9,067,651 B1
(45) Date of Patent: Jun. 30, 2015

(54) INFLATABLE FLEX WING WATER FLOAT

(71) Applicant: SDS Asia Limited, BVI #-1748971, Hong Kong (CN)

(72) Inventor: Leroy L. Peterson, Omaha, NE (US)

(73) Assignee: SDS Asia Limited, BVI #1748971, Hong Kong (CN)

( * ) Notice: Subject to any disclaimer, the term of this patent is extended or adjusted under 35 U.S.C. 154(b) by 0 days.

(21) Appl. No.: 14/043,680

(22) Filed: Oct. 1, 2013

Related U.S. Application Data

(60) Provisional application No. 61/708,718, filed on Oct. 2, 2012.

(51) Int. Cl.
*B63B 35/73* (2006.01)

(52) U.S. Cl.
CPC ..... *B63B 35/73* (2013.01)

(58) Field of Classification Search
CPC ..... B63B 35/74; B63B 7/08
USPC ..... 441/66, 62; 114/345
See application file for complete search history.

(56) References Cited

U.S. PATENT DOCUMENTS

| | | | | | |
|---|---|---|---|---|---|
| 3,056,979 | A * | 10/1962 | Holladay | 441/66 |
| 4,762,078 | A * | 8/1988 | Palmer, Jr. | 114/61.25 |
| 4,807,554 | A * | 2/1989 | Chi-Hung | 114/345 |
| 5,006,087 | A * | 4/1991 | Peterson | 441/66 |
| 5,101,752 | A * | 4/1992 | Smollar et al. | 114/345 |
| 5,367,974 | A * | 11/1994 | Moraga et al. | 114/345 |
| 5,482,485 | A * | 1/1996 | Ball | 441/65 |
| 6,155,899 | A * | 12/2000 | Boddy | 441/130 |
| 6,257,943 | B1 * | 7/2001 | Peterson | 441/129 |
| 6,582,264 | B2 * | 6/2003 | Brown | 441/40 |
| D480,443 | S * | 10/2003 | Peterson | D21/770 |
| D501,238 | S * | 1/2005 | Peterson | D21/769 |
| D505,987 | S * | 6/2005 | Peterson | D21/770 |
| 6,945,836 | B1 * | 9/2005 | Lorier | 441/66 |
| 6,997,133 | B1 * | 2/2006 | Song et al. | 114/345 |
| 7,261,607 | B1 * | 8/2007 | Klimenko | 441/65 |
| D552,204 | S * | 10/2007 | Peterson et al. | D21/803 |
| 7,309,268 | B2 * | 12/2007 | Klimenko | 441/66 |
| D571,888 | S * | 6/2008 | Brown | D21/801 |
| D580,006 | S * | 11/2008 | Peterson | D21/809 |
| 7,887,066 | B2 * | 2/2011 | Knarvik | 280/18 |
| D662,166 | S * | 6/2012 | Peterson | D21/809 |
| D662,564 | S * | 6/2012 | Peterson | D21/809 |
| D679,770 | S * | 4/2013 | Berenson | D21/803 |
| 8,708,706 | B2 * | 4/2014 | Plante | 434/253 |
| 2007/0254541 | A1 * | 11/2007 | Sorby | 441/66 |
| 2008/0207068 | A1 * | 8/2008 | Rockstad et al. | 441/66 |

* cited by examiner

*Primary Examiner* — Lars A Olson
*Assistant Examiner* — Jovon Hayes
(74) *Attorney, Agent, or Firm* — Suiter Swantz pc llo

(57) ABSTRACT

A towable aquatic vehicle with flexible wings is disclosed. The towable aquatic vehicle includes one or more elongated inflatable tubes and two flexible inflatable wings. The one or more elongated inflatable tubes have first and second outer sides, each defining an elongated edge of the one or more elongated inflatable tubes. A first inflatable wing is pivotally secured to the first side of the one or more elongated inflatable tubes, and a second inflatable wing is pivotally secured to the second side of the one or more elongated inflatable tubes. The first inflatable wing and the second inflatable wing are positioned opposite with respect to each other. The towable aquatic vehicle with flexible wings provides steerability to the rider/user and allows the user to ride the towable aquatic vehicle in various different riding positions.

20 Claims, 18 Drawing Sheets

INFLATABLE FLEX WING WATER FLOAT

CROSS-REFERENCE TO RELATED APPLICATIONS

The present application claims the benefit under 35 U.S.C. §119(e) of U.S. Provisional Application Ser. No. 61/708,718, filed Oct. 2, 2012. Said U.S. Provisional Application Ser. No. 61/708,718 is hereby incorporated by reference in its entirety.

TECHNICAL FIELD

The disclosure generally relates to the field of inflatable devices, particularly to an inflatable water float.

BACKGROUND

Various types of recreational aquatic activities have long been popular with children and adults alike. Floatation devices such as floating tubes/beds and the like have been utilized in some of these activities. Some of these floatation devices may be inflatable. For example, an inflatable water float may form a towable aquatic vehicle that floats on water, allowing a person to ride on the aquatic vehicle.

However, existing towable aquatic vehicles have limited steerability and limited riding position. Therein lies a need for a towable aquatic vehicle without these shortcomings.

SUMMARY

The present disclosure is directed to a towable aquatic vehicle. The towable aquatic vehicle includes one or more elongated inflatable tubes and two flexible inflatable wings. The one or more elongated inflatable tubes have first and second outer sides, each defining an elongated edge of the one or more elongated inflatable tubes. A first inflatable wing is pivotally secured to the first side of the one or more elongated inflatable tubes, and a second inflatable wing is pivotally secured to the second side of the one or more elongated inflatable tubes. The first inflatable wing and the second inflatable wing are positioned opposite with respect to each other.

A further embodiment of the present disclosure is also directed to a inflatable aquatic assembly. The inflatable aquatic assembly includes a first inflatable wing pivotally secured to a first side of a towable aquatic vehicle, wherein the first side defines a first elongated outer edge of the towable aquatic vehicle; and a second inflatable wing pivotally secured to a second side of the towable aquatic vehicle, wherein the second side defines a second elongated outer edge of the towable aquatic vehicle, the first inflatable wing and the second inflatable wing being positioned opposite with respect to each other.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Figure 1:
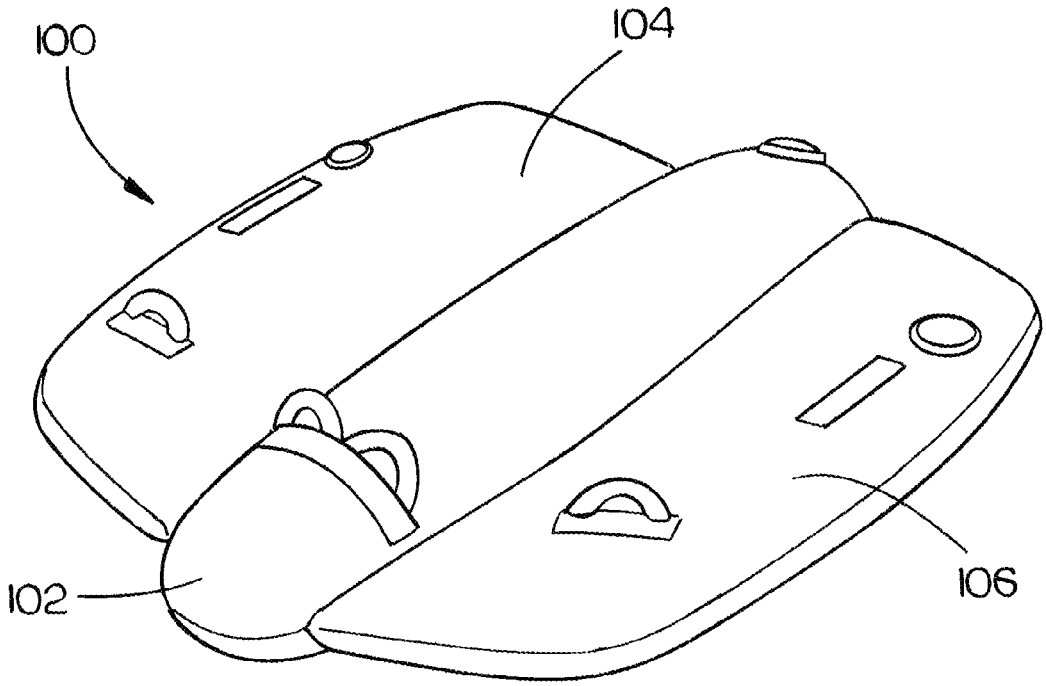
FIG. 1 is an isometric view of a towable aquatic vehicle.

Reference will now be made in detail to the subject matter disclosed, which is illustrated in the accompanying drawings.

The present disclosure is directed to a towable aquatic vehicle having flexible wings to provide steerability to the rider/user. The towable aquatic vehicle in accordance with the present disclosure also allows the user to ride the towable aquatic vehicle in various different riding positions. For example, the user may steer, slalom, sit, kneel, lay, stand or roll when the aquatic vehicle is being towed.

Referring generally to FIGS. 1 through 10, a towable aquatic vehicle 100 is shown. The aquatic vehicle 100 may include one or more inflatable tubes 102 and at least two inflatable wings 104 and 106. When inflated, each of the one or more inflatable tubes 102 may form an elongated substantially cylindrical (or elliptical cylindrical) shape. In addition, the two opposite ends of each of the one or more elongated inflatable tubes 102 may be tapered. It is further contemplated that the one or more inflatable tubes 102 may form a variety of alternative shapes having at least two oppositely disposed elongated edges configured for receiving the two inflatable wings 104 and 106.

In one embodiment, the two inflatable wings 104 and 106 may be pivotally secured to the two opposite sides of one inflatable tube 102. Alternatively, the two inflatable wings 104 and 106 may be secured to two opposite sides defined by two or more inflatable tubes 102 coupled to each another. For example, two inflatable tubes 102 may be positioned parallel to each other and coupled to each other along the inner edges of the two inflatable tubes 102 with each of the two tubes having one of the two inflatable wings secured to its outer edge. It is further contemplated that the aquatic vehicle may have any number of shapes having at least two oppositely disposed elongated edges configured for receiving the two inflatable wings 104 and 106, including but not limited to aquatic vehicle shapes illustrated in the figures.

Figure 6:
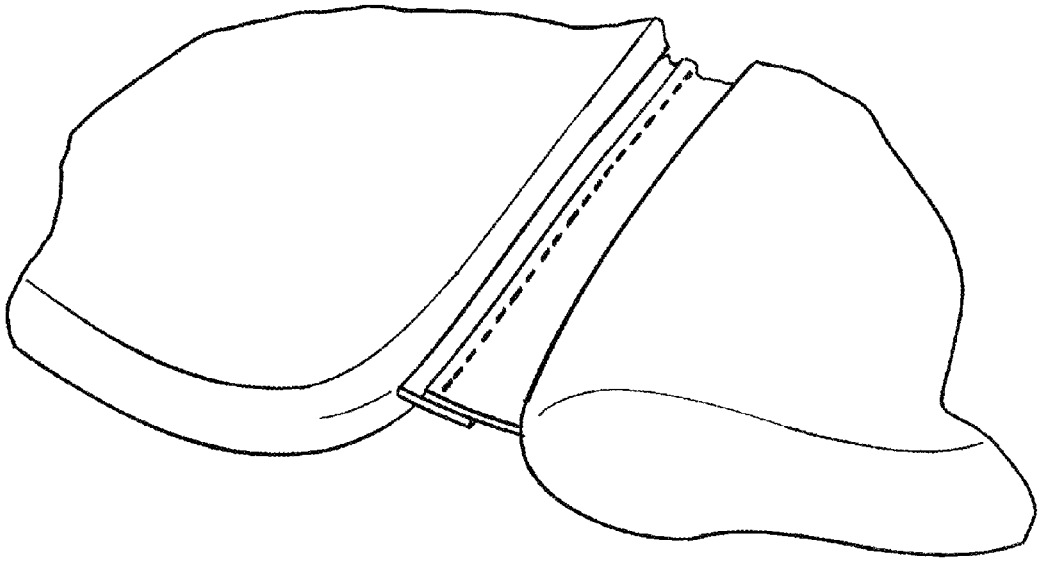
FIG. 6 is an illustration depicting a sewn stitched/webbing type of connection/fastening mechanism.
Figure 7:
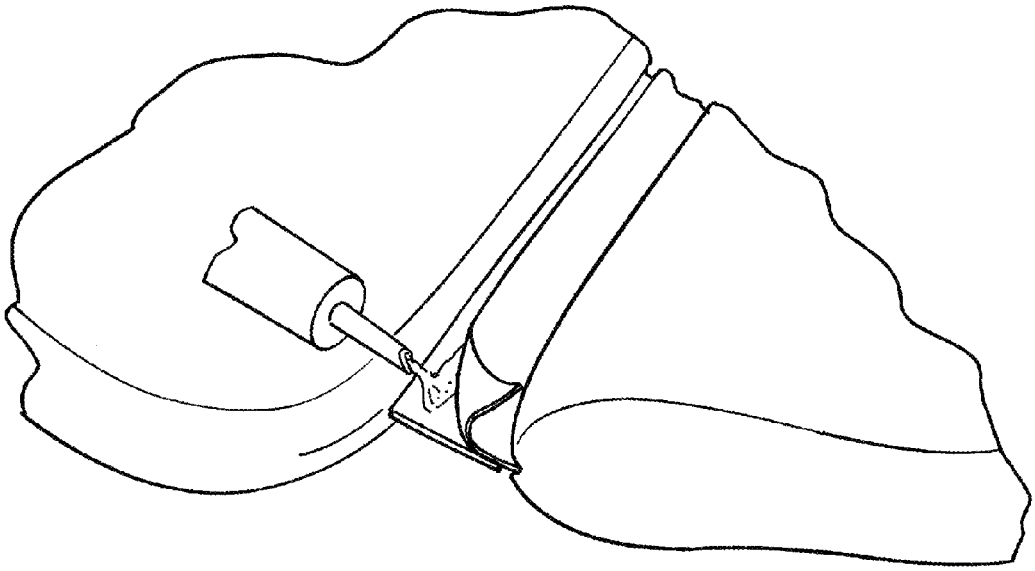
FIG. 7 is an illustration depicting a glued type of connection/fastening mechanism.
Figure 10:
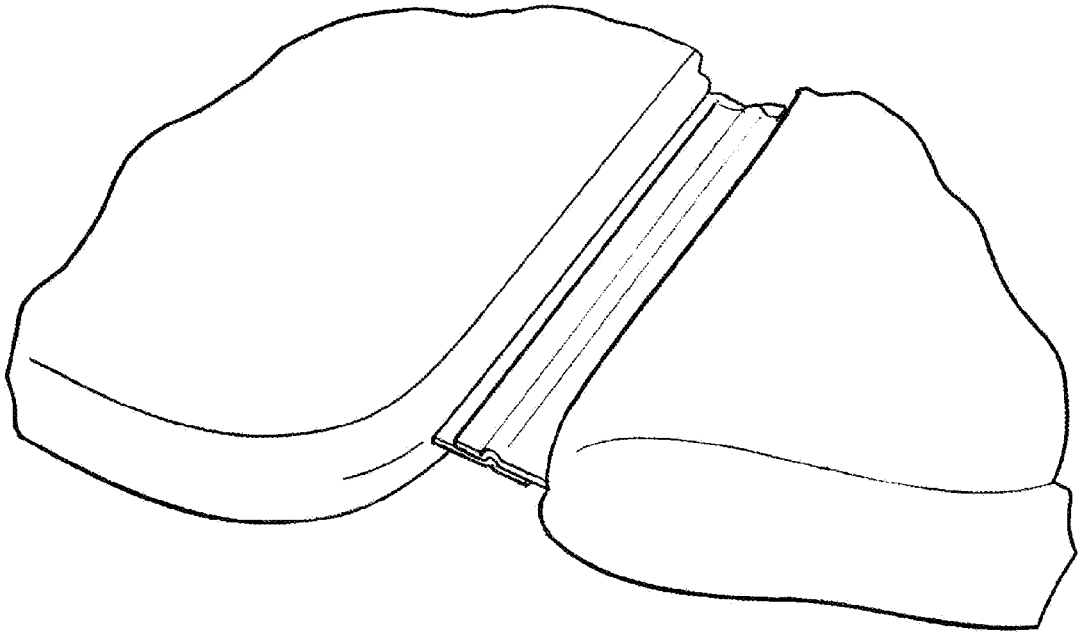
FIG. 10 is an illustration depicting a heat sealed type of connection/fastening mechanism.
Figure 11:
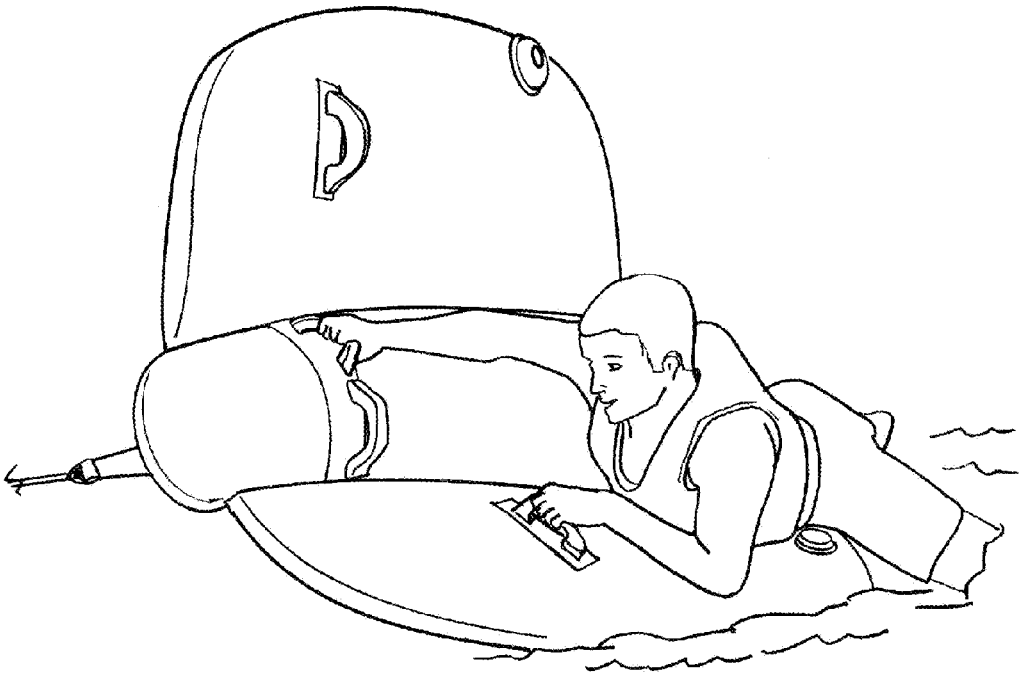
FIG. 11 is an illustration depicting an exemplary towable aquatic vehicle and an exemplary riding position supported by the towable aquatic vehicle in accordance with the present disclosure.

In one embodiment, the two inflatable wings 104 and 106 may be permanently secured to corresponding sides of the one or more inflatable tubes 102. For instance, as illustrated in FIGS. 6, 7 and 10, connection mechanisms such as sewn stitched connection, sewn webbing connection, heat sealed connection, glue connection or the like may be utilized to permanently secure the inflatable wings 104 and 106 to the one or more inflatable tubes 102.

Figure 8:
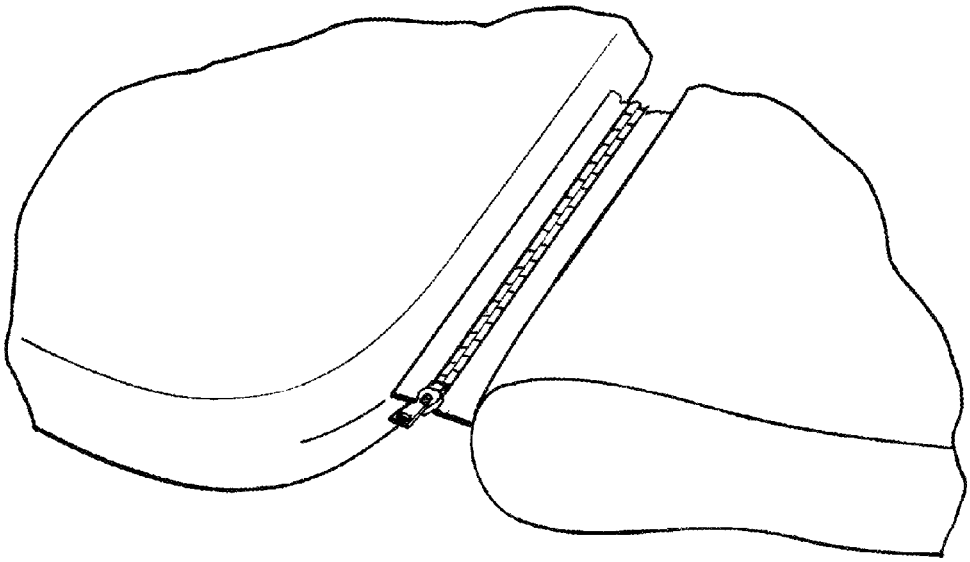
FIG. 8 is an illustration depicting a zipper type of connection/fastening mechanism.
Figure 9:
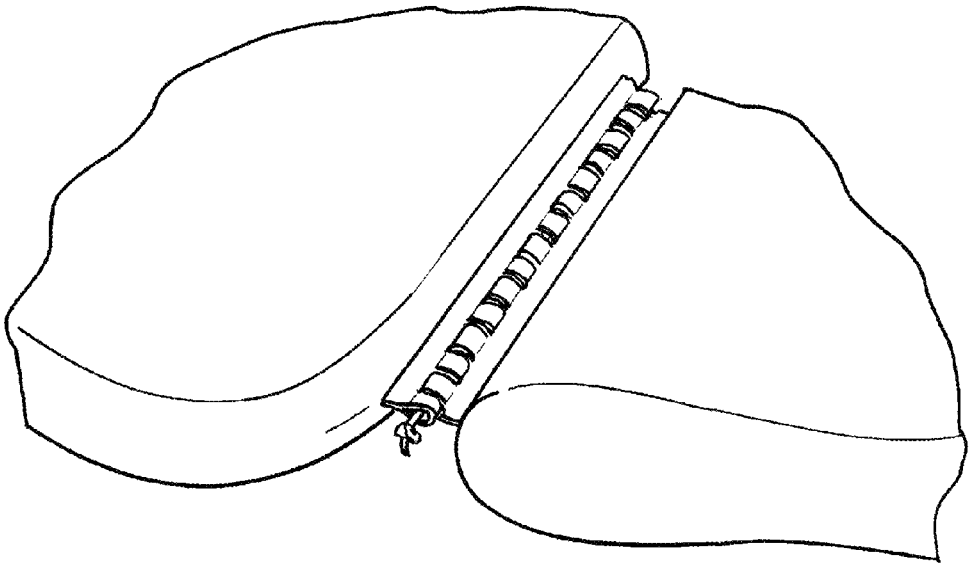
FIG. 9 is an illustration depicting woven loops type of connection/fastening mechanism.

Alternatively, the two inflatable wings 104 and 106 may be removably secured to corresponding sides of the one or more inflatable tubes 102. For instance, as illustrated in FIGS. 8 and 9, a pair of fastening mechanisms may be respectively disposed on the two sides of the one or more inflatable tubes 102. The fastening mechanisms may removably connect the inflatable wings to the one or more inflatable tubes 102 utilizing various fastening mechanisms such as a zipper fastening mechanism, a loop connection fastening mechanism, a snap connection fastening mechanism, a Velcro connection fastening mechanism, a buckled connection fastening mechanism, a grommet with rope connection fastening mechanism, a grommet fastening mechanism or the like.

However, regardless of whether the inflatable wings 104 and 106 are permanently or removably secured to the corresponding sides of the one or more inflatable tubes 102, the connection/fastening mechanisms being utilized must be flexible and to allow the inflatable wings 104 and 106 to pivot with respect to the one or more inflatable tubes 102 of the aquatic vehicle 100. Such a configuration is necessary for providing steerability to the user, and for allowing the user to ride the aquatic vehicle 100 in various different riding positions.

Figure 2:
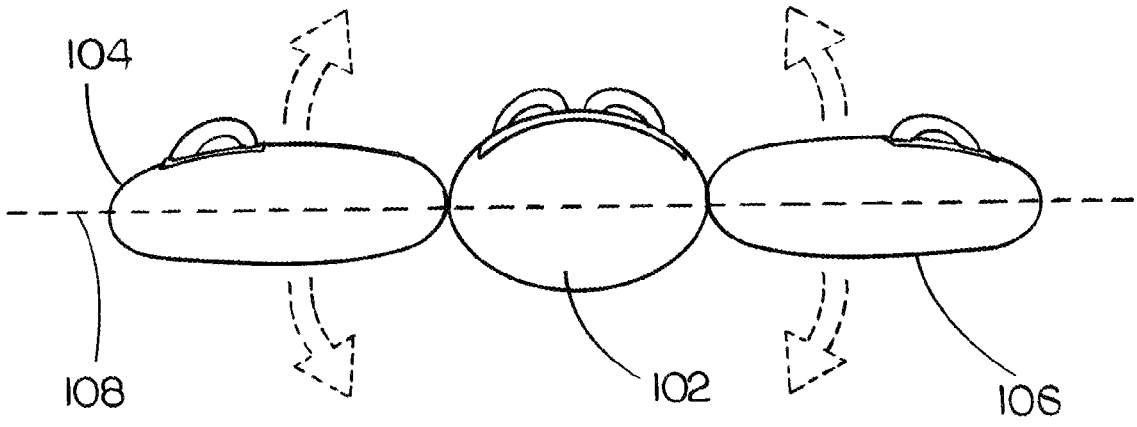
FIG. 2 is a front elevation view of the towable aquatic vehicle depicted in FIG. 1.
Figure 3:
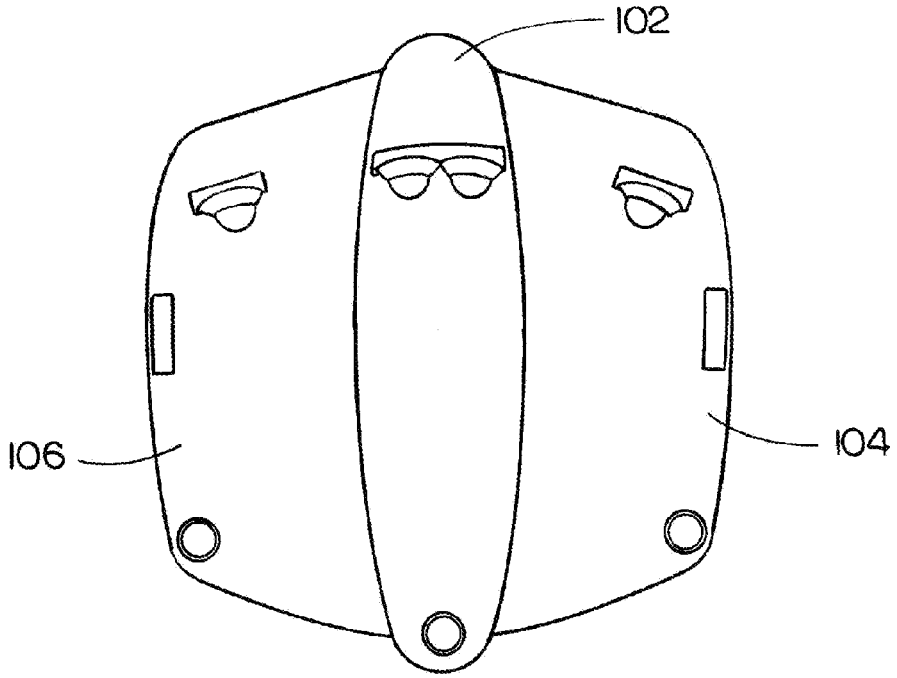
FIG. 3 is a top view of the towable aquatic vehicle depicted in FIG. 1.
Figure 4:
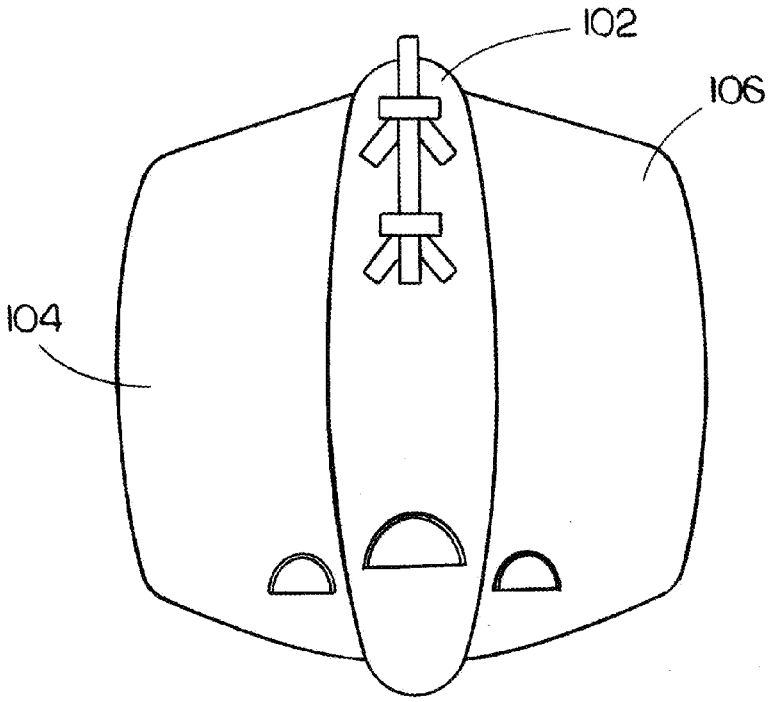
FIG. 4 is a bottom view of the towable aquatic vehicle depicted in FIG. 1

In one embodiment, each connection/fastening mechanism is configured to extend along a majority of the full length of the corresponding side of the one or more inflatable tubes 102. For example, each connection/fastening mechanism may extend along at least 80% of the elongated side of the one or more inflatable tubes 102. In addition, the fastening mechanisms may be positioned on a plane 108 that is centrally located between the top and the bottom of the one or more inflatable tubes 102 as shown in FIG. 2. Such a configuration may provide maximum flexibilities for the inflatable wings 104 and 106, which may be appreciated in various applications.

It is contemplated that while the examples above reference the one or more inflatable tubes 102 and the inflatable wings 104 and 106 separately, they may be formed by dividing a single fabricated piece into three or more separate chambers (e.g., by heat sealing or the like). Alternatively, they may be fabricated as individual pieces and joined together (either permanently or removably, as described above). It is understood that the specific process utilized to produce the aquatic vehicle 100 may vary without departing from the spirit and scope of the present disclosure, as long as the aquatic vehicle 100 includes one or more inflatable tubes 102 with at least two pivotally secured inflatable wings 104 and 106 disposed one substantially opposite sides of the aquatic vehicle 100.

It is also contemplated that the one or more inflatable tubes 102 and the inflatable wings 104 and 106 may be made of various types of flexible materials such as plastics or the like. The specific material utilized for producing the aquatic vehicle 100 may also vary without departing from the spirit and scope of the present disclosure. In addition, due to the nature of the one or more inflatable tubes 102 and the inflatable wings 104 and 106 being inflatable, it is contemplated that certain corners/edges/sides may be rounded or curved when inflated.

It is further contemplated that a plurality of handles may be positioned on the aquatic vehicle 100. In the example depicted in the figures, at least one handle is positioned on the inflatable tube 102 and at least one handle is positioned on each of the first and second inflatable wings 104 and 106. However, the number of handles and their specific locations may vary without departing from the spirit and scope of the present disclosure.

Figure 5:
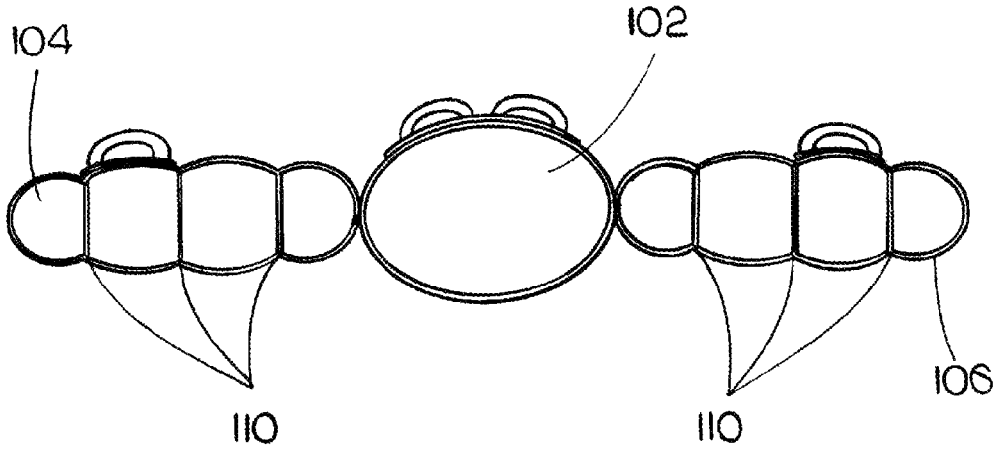
FIG. 5 is a front elevation cross sectional view of the towable aquatic vehicle depicted in FIG. 1, illustrating the internal support structures within the inflatable wings.

Furthermore, as illustrated in FIG. 5, the inflatable wings 104 and 106 may each include some internal support structures 110 such as vertical beams (or I-beams), wave beams, X-beams or the like. Such internal support structures 110 may allow the inflatable wings 104 and 106 to support more weight, thus allowing the user to ride the aquatic vehicle 100 in more riding positions (e.g., standing on one of the wings as will be described below).

In one particular implementation, when inflated, the inflatable tube 102 may have a length of approximately 5 to 10 feet and a width of approximately 2 to 6 feet. Furthermore, the width of each inflatable wings 104 and 106 may be approximately 1.5 to 2 times the width of the inflatable tube 102. However, it is contemplated that the specific dimensions described above are merely exemplary. The aquatic vehicle 100 may vary in size without departing from the spirit and scope of the present disclosure.

In one embodiment, the support structures 114 are configured to be generally parallel to the two short sides 112 of the inflatable mat 102 (and are therefore generally parallel relative to each other). In addition, the support structures 114 are disposed substantially evenly in between the two short sides 112. The distance d between two adjacent support structures 114 may be between approximately 1 and 3 inches. Furthermore, the height h of the support structures 114 may be between approximately 4 and 6 inches. Such a configuration allows the inflatable mat 102 to provide sufficient support for individual(s) using the inflatable mat 102, even when the individual(s) is in standing position and/or walking.

Figure 12:
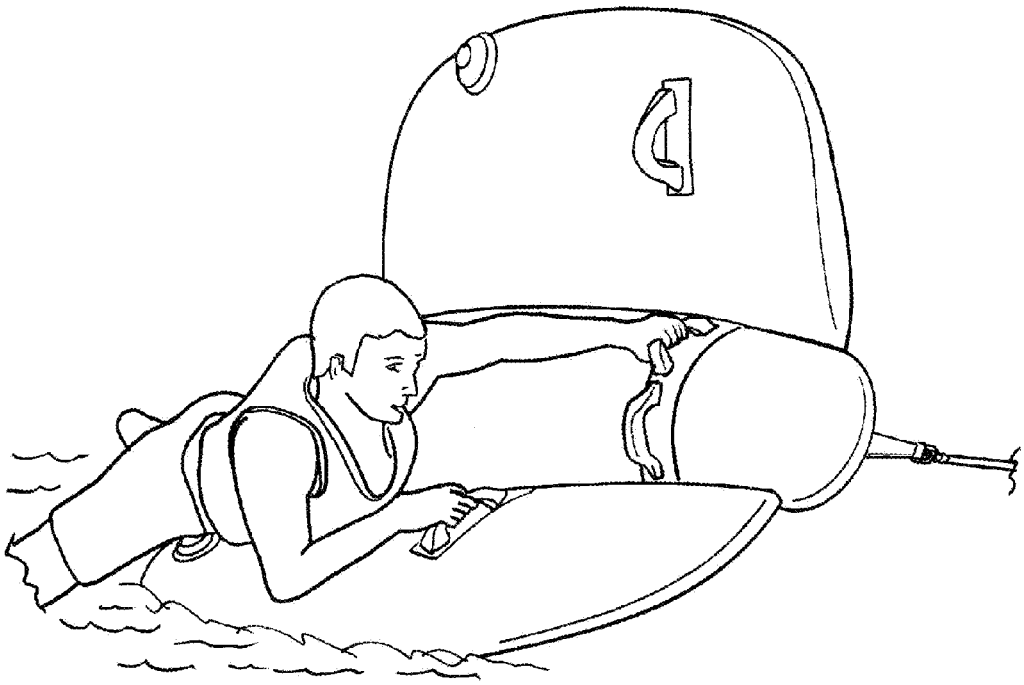
FIG. 12 is an illustration depicting an exemplary towable aquatic vehicle and an exemplary riding position supported by the towable aquatic vehicle in accordance with the present disclosure.
Figure 13:
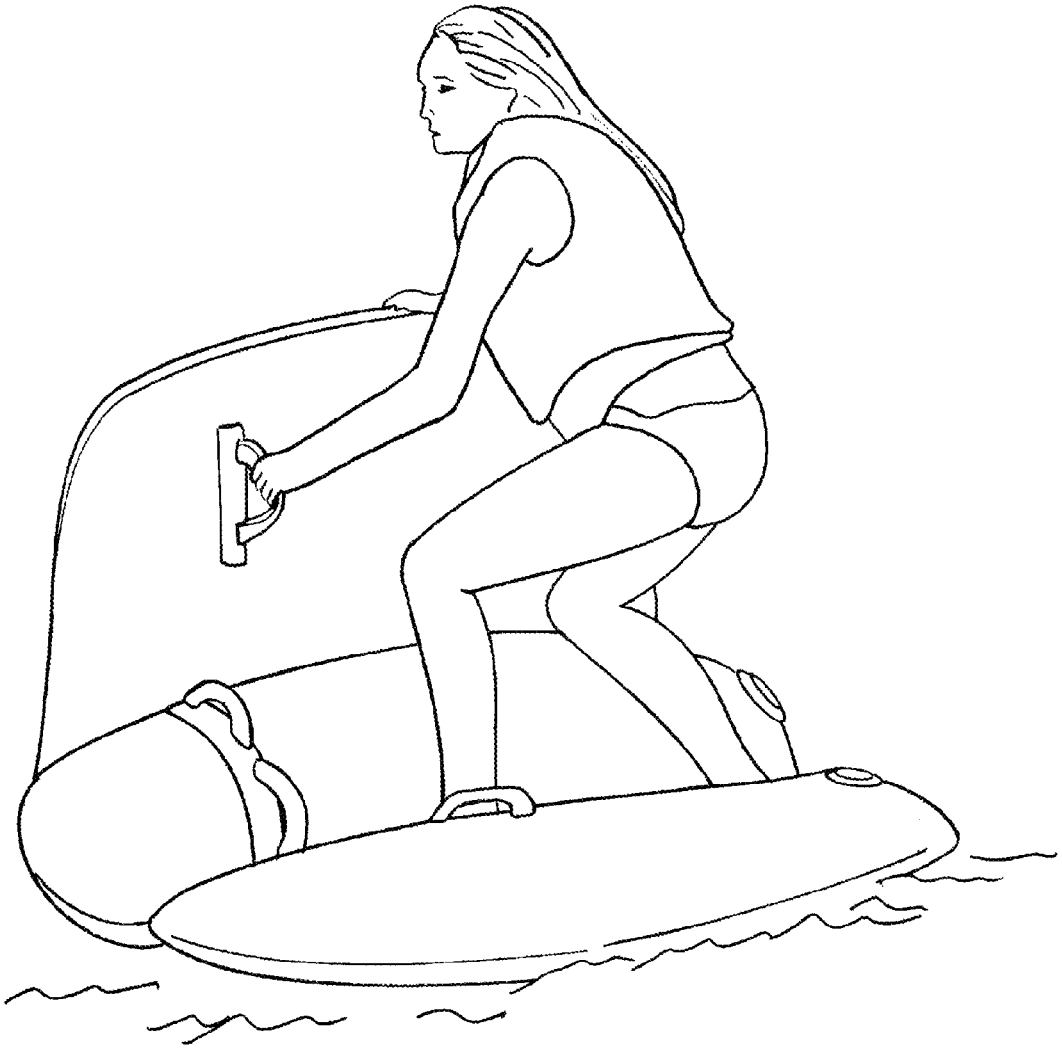
FIG. 13 is an illustration depicting an exemplary towable aquatic vehicle and an exemplary riding position supported by the towable aquatic vehicle in accordance with the present disclosure.
Figure 14:
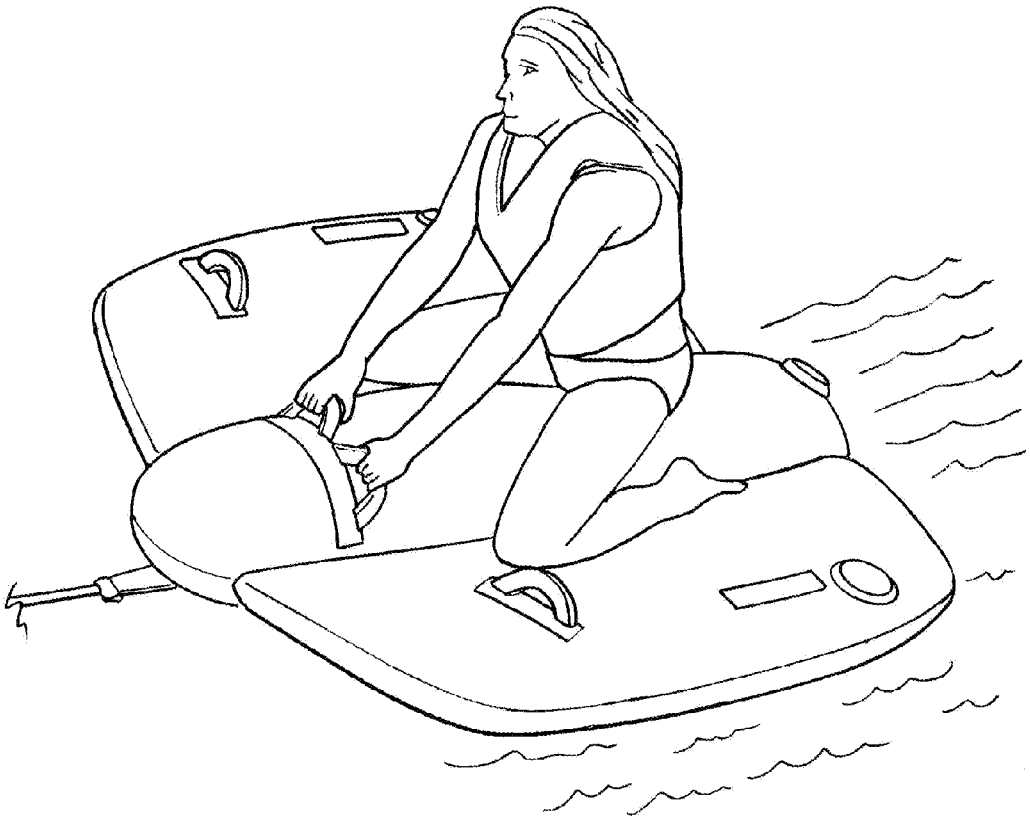
FIG. 14 is an illustration depicting an exemplary towable aquatic vehicle and an exemplary riding position supported by the towable aquatic vehicle in accordance with the present disclosure.
Figure 15:
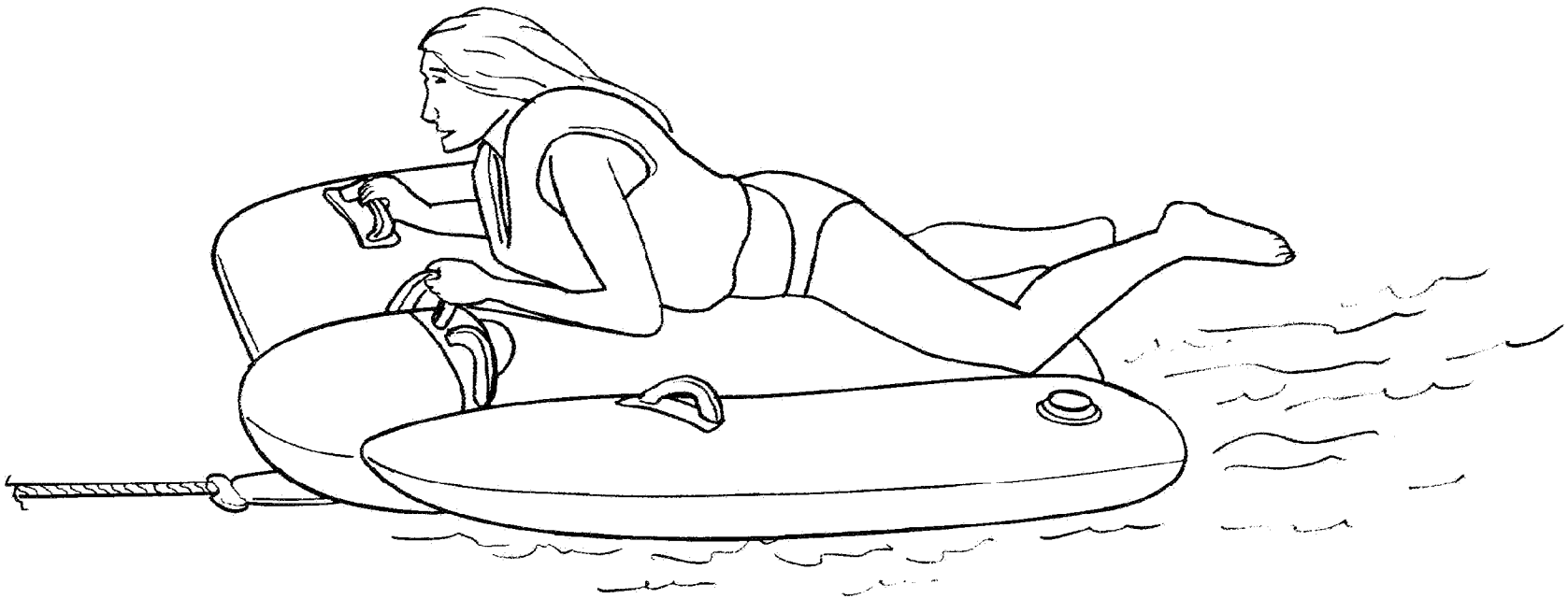
FIG. 15 is an illustration depicting an exemplary towable aquatic vehicle and an exemplary riding position supported by the towable aquatic vehicle in accordance with the present disclosure.
Figure 16:
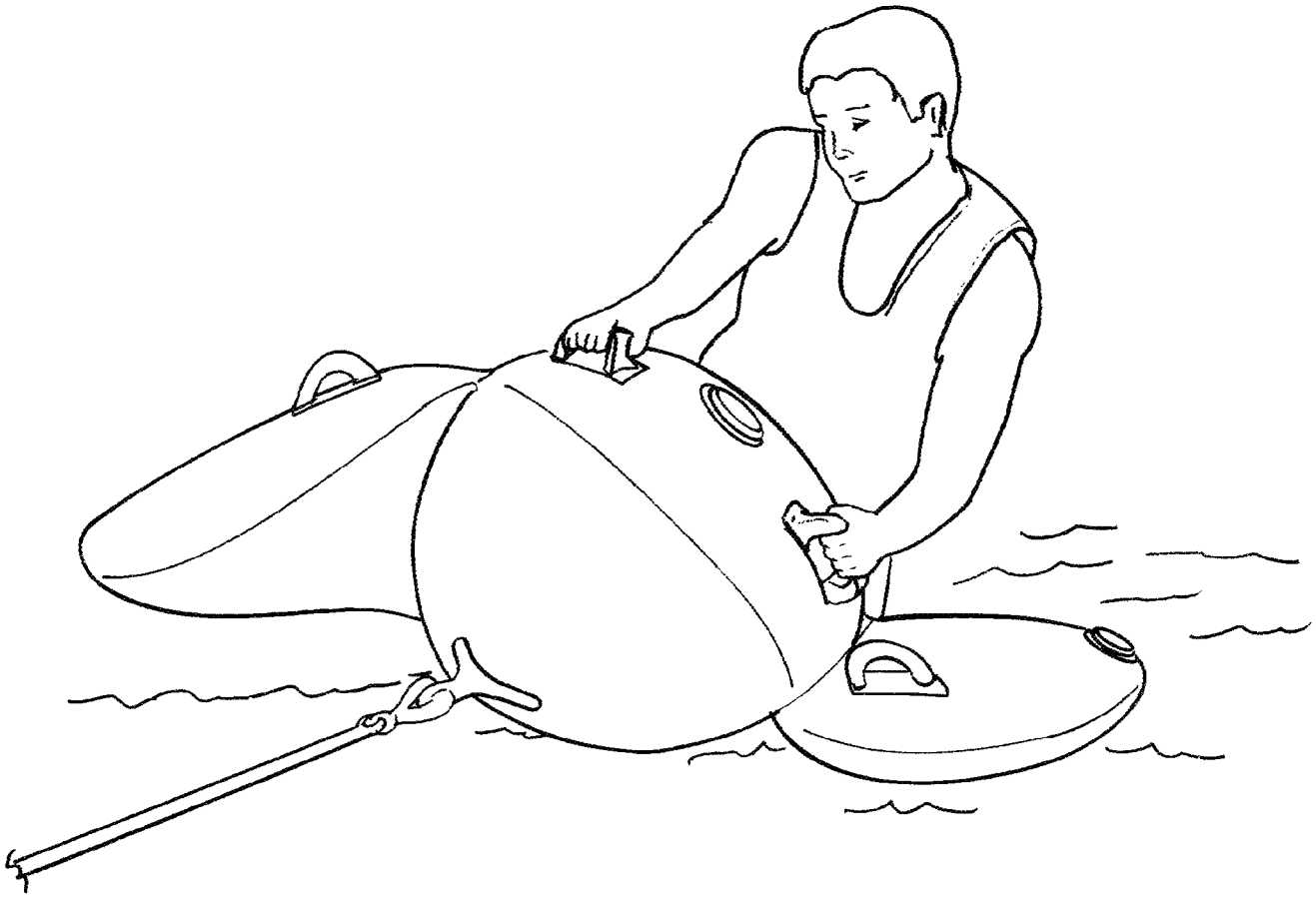
FIG. 16 is an illustration depicting an exemplary towable aquatic vehicle and an exemplary riding position supported by the towable aquatic vehicle in accordance with the present disclosure.
Figure 17:
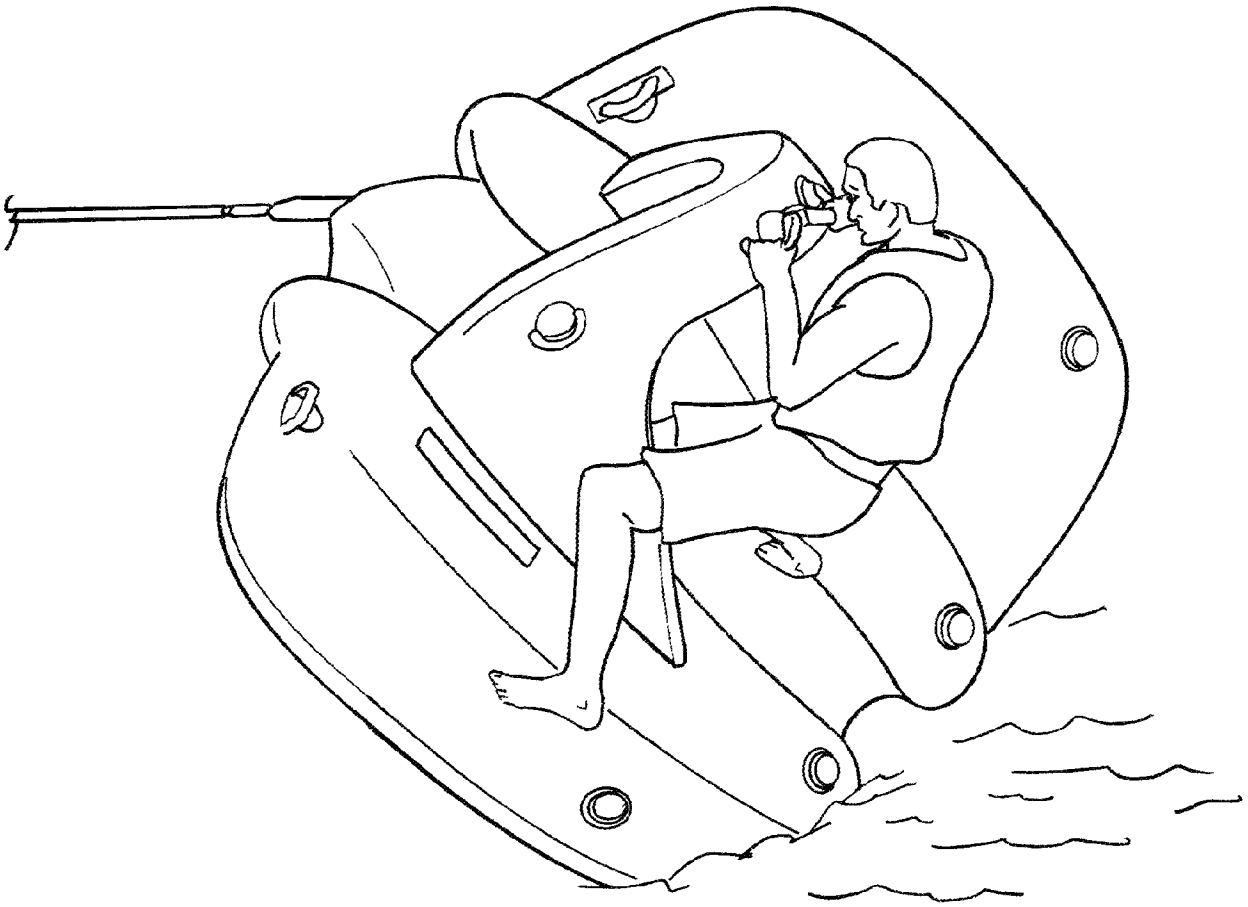
FIG. 17 is an illustration depicting an exemplary towable aquatic vehicle and an exemplary riding position supported by the towable aquatic vehicle in accordance with the present disclosure.

FIGS. 12 through 23 are illustrations depicting various aquatic vehicles in accordance with the present disclosure and various riding positions supported by such aquatic vehicles. As illustrated in FIGS. 12 and 13, the user may utilize the flexible wings to steer the aquatic vehicle. The user may also hold the two flexible wings towards each other, forming a generally U-shaped riding platform, which may allow the user to roll. Additionally/alternatively, the user may stand on one of the flexible wings and may hold the handles positioned on the other wing for stability, as illustrated in FIG. 13. The user may also assume other riding positions such as laying or standing as illustrated in the figures.

Figure 18:
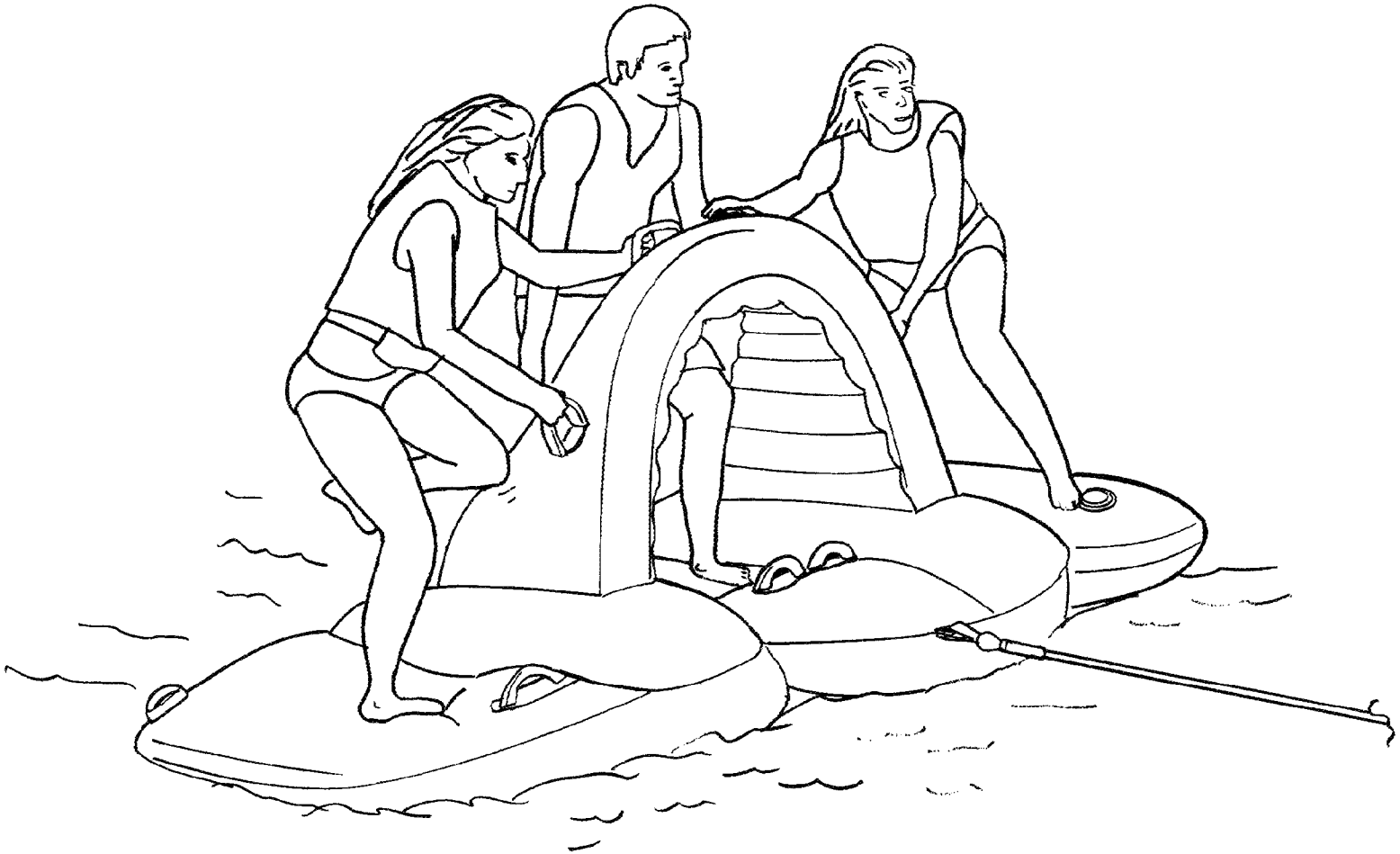
FIG. 18 is an illustration depicting an exemplary towable aquatic vehicle and an exemplary riding position supported by the towable aquatic vehicle in accordance with the present disclosure.
Figure 19:
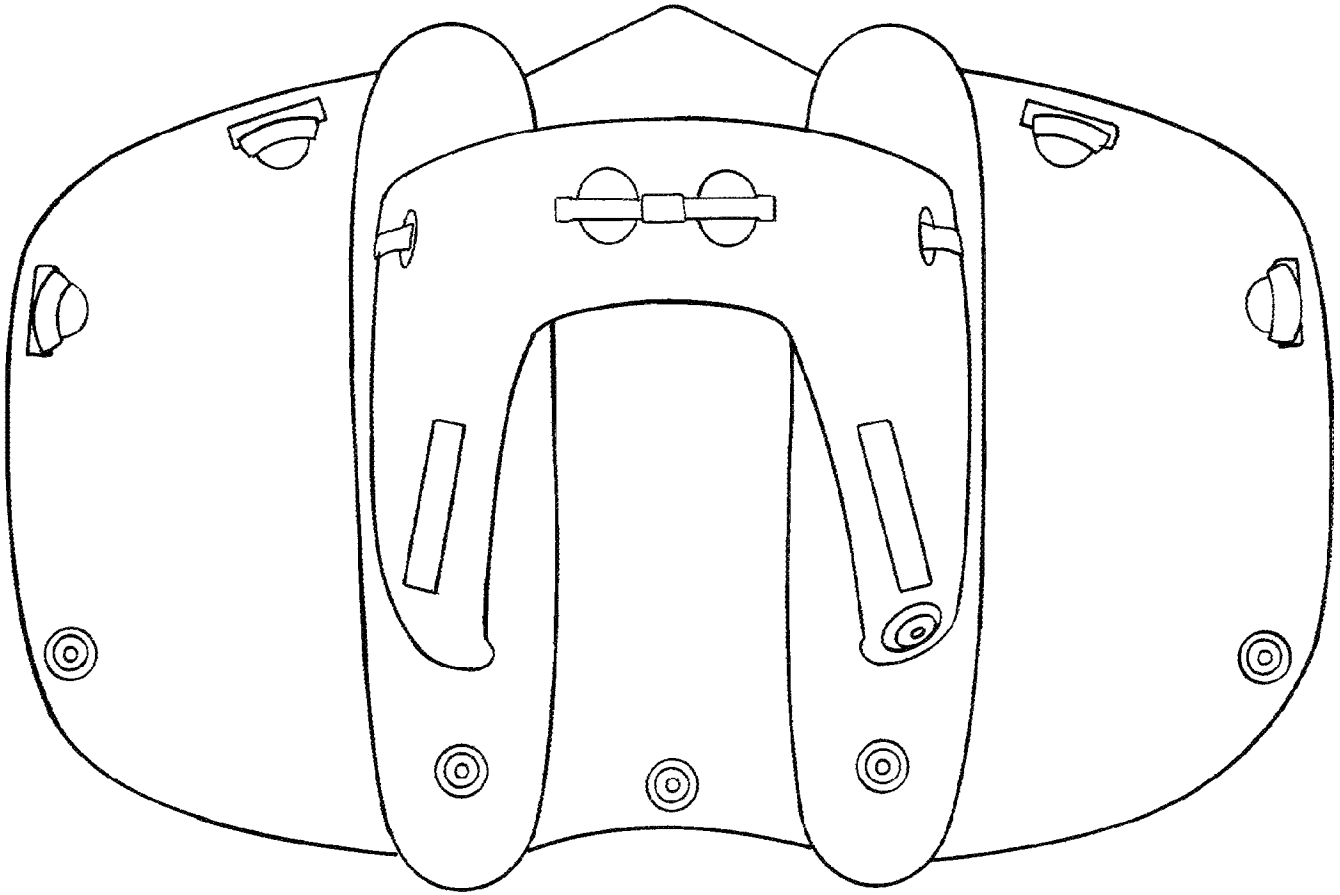
FIG. 19 is a top view of the an exemplary towable aquatic vehicle in accordance with the present disclosure.
Figure 20:
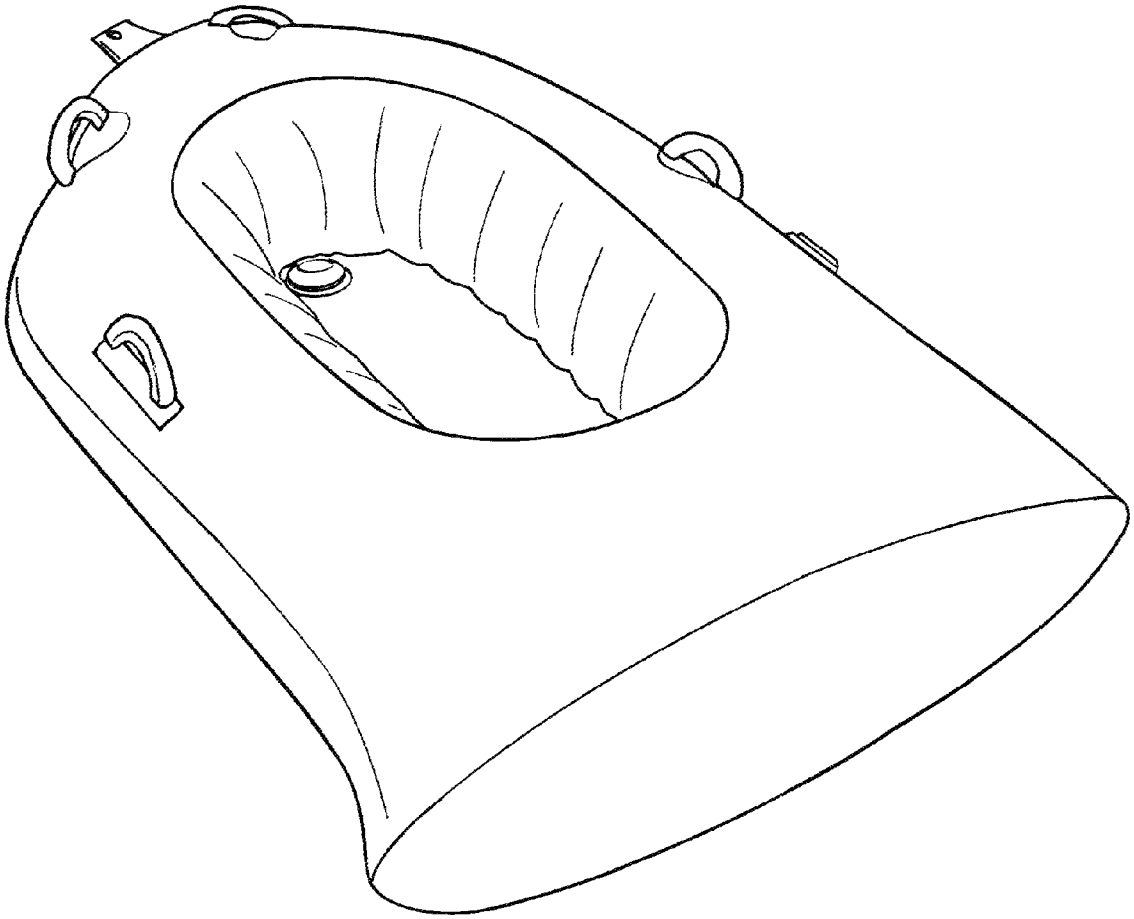
FIG. 20 is an isometric view of a towable aquatic vehicle with a recessed center portion.
Figure 21:
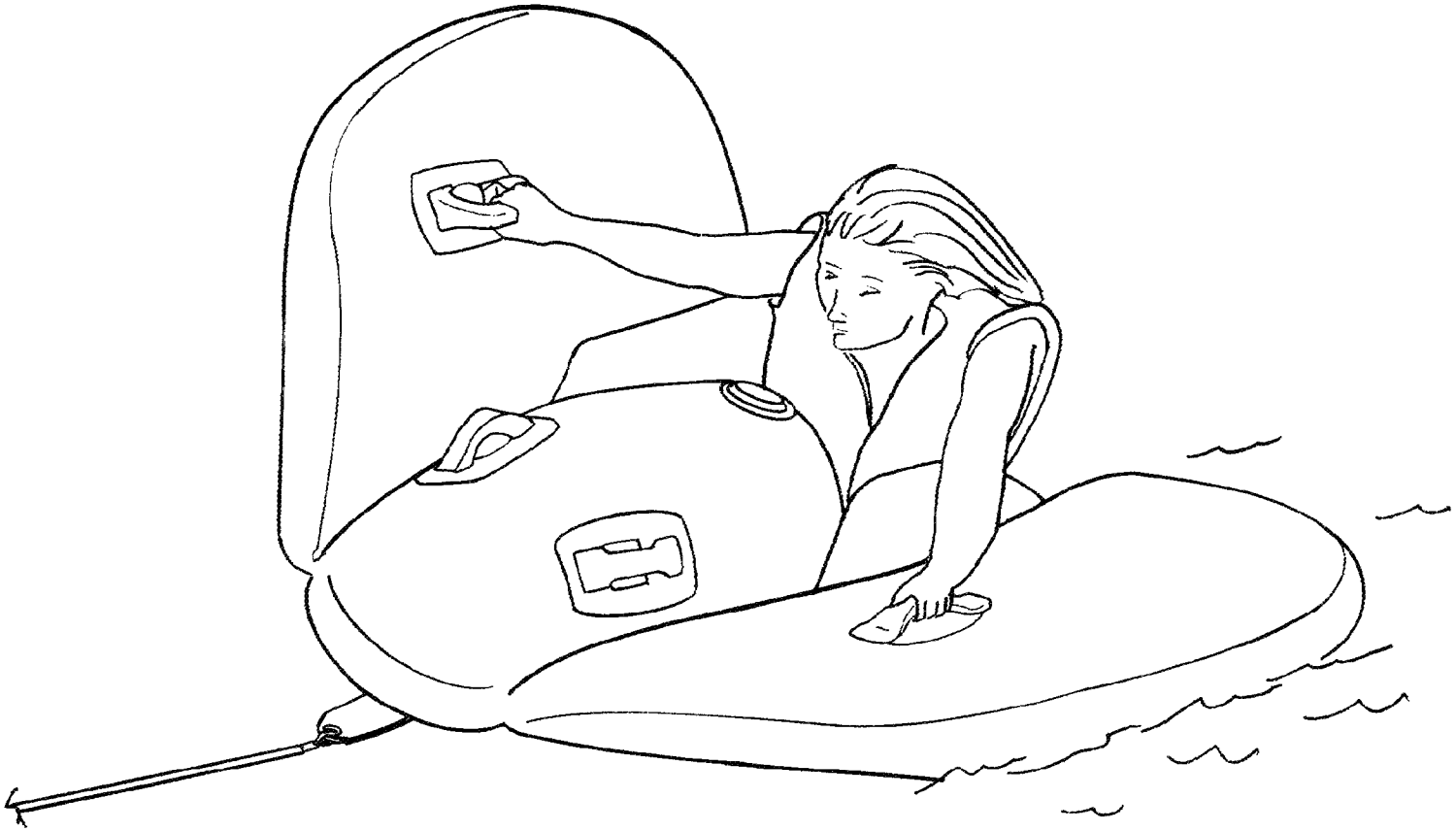
FIG. 21 is an illustration depicting an exemplary towable aquatic vehicle and an exemplary riding position supported by the towable aquatic vehicle in accordance with the present disclosure.
Figure 22:
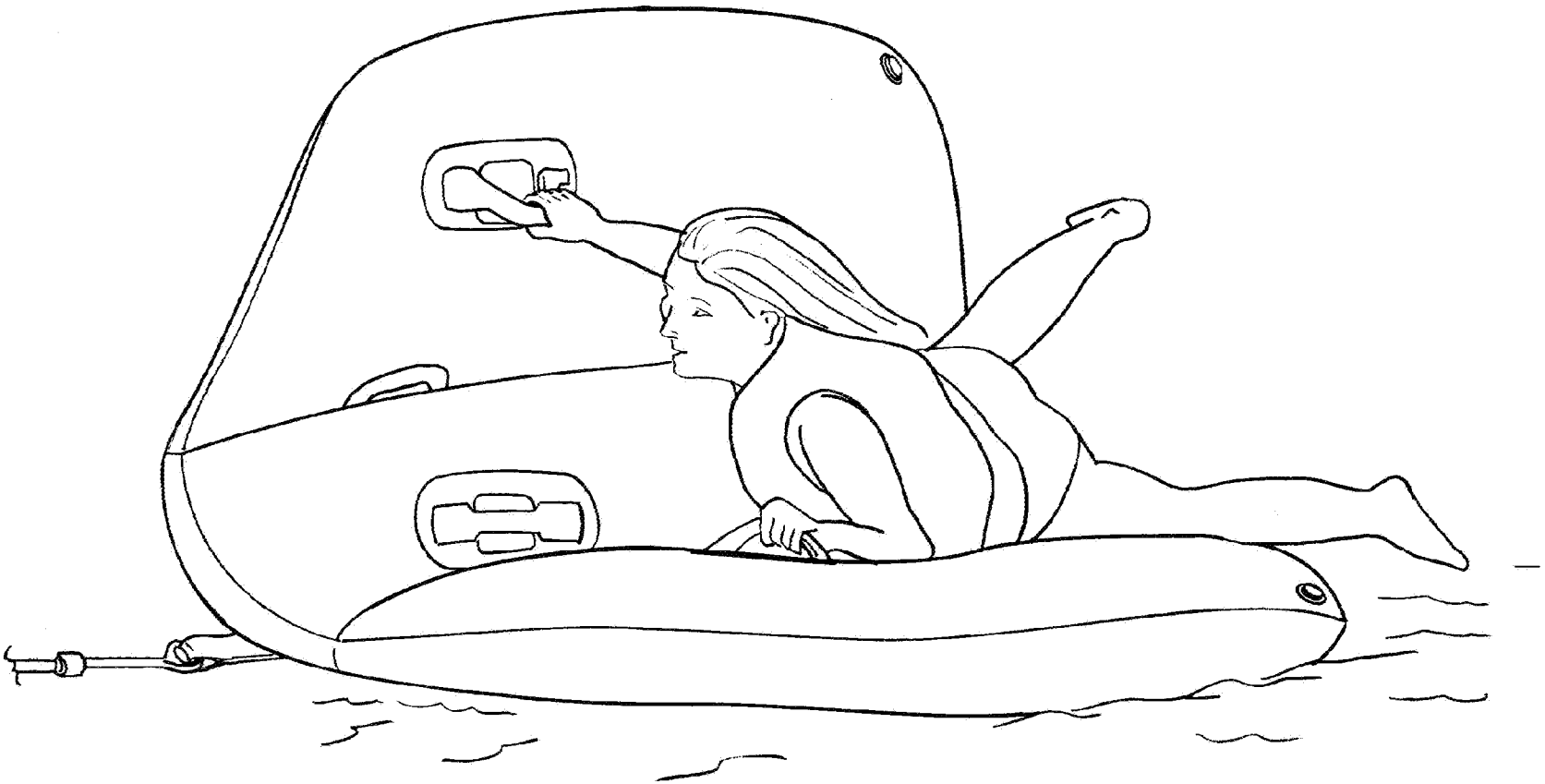
FIG. 22 is an illustration depicting an exemplary towable aquatic vehicle and an exemplary riding position supported by the towable aquatic vehicle in accordance with the present disclosure.
Figure 23:
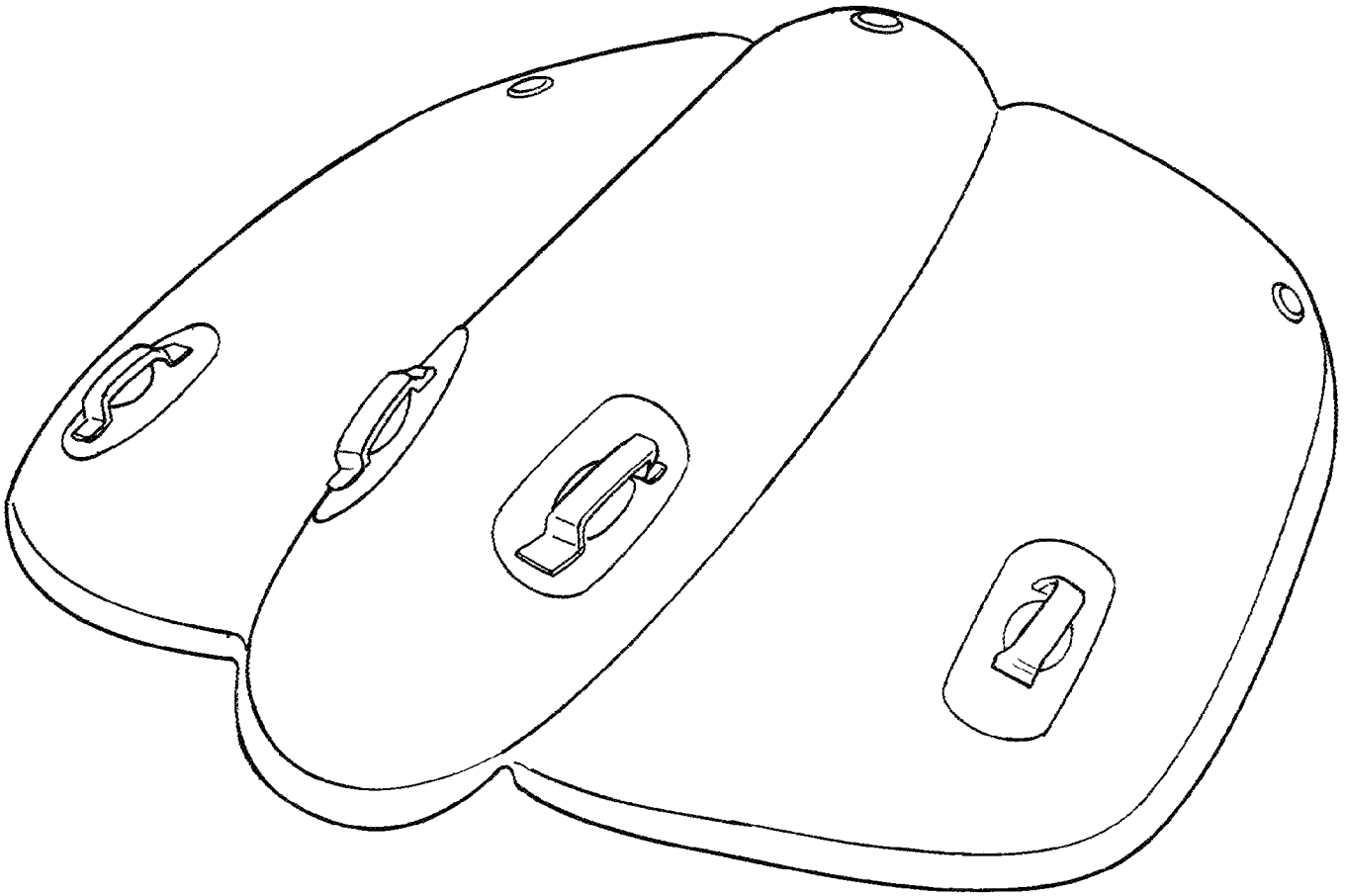
FIG. 23 is an isometric view of a towable aquatic vehicle having an alternative handle configuration.

It is contemplated that the inflatable tube (referred to as element 102 in FIGS. 1 through 5) located between the flexible wings is not required to for an elongated cylindrical shape. For instance, a recessed portion (e.g., as shown in FIG. 20) may be formed to provide a sitting area for the rider(s). Alternatively/additionally, an inflatable handle portion (e.g., as shown in FIGS. 18 and 19) may be formed to provide additional handles for riders in standing positions. It is contemplated that the inflatable tube 102 may be configured to form various other shapes without departing from the spirit and scope of the present disclosure.

It is understood that the present disclosure is not limited to any underlying implementing technology. The present disclosure may be implemented using a variety of technologies without departing from the scope and spirit of the invention or without sacrificing all of its material advantages.

It is believed that the present disclosure and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A towable aquatic vehicle, comprising:

one or more elongated inflatable tubes, the one or more elongated inflatable tubes having first and second outer sides, the first outer side defining a first connection line extending along an elongated edge of the first outer side, and the second outer side defining a second connection line extending along an elongated edge of the second outer side;

a first inflatable wing pivotally secured to the first outer side of the one or more elongated inflatable tubes along the first connection line; and a second inflatable wing pivotally secured to the second outer side of the one or more elongated inflatable tubes along the second connection line, the first inflatable wing and the second inflatable wing being positioned opposite with respect to each other.

2. The towable aquatic vehicle of claim 1, wherein the one or more elongated inflatable tubes include one elongated inflatable tube having first and second elongated edges, each edge configured for receiving the corresponding inflatable wing.

3. The towable aquatic vehicle of claim 1, wherein the one or more elongated inflatable tubes include two or more elongated inflatable tubes coupled to each other, a first tube of the two or more elongated inflatable tubes having an elongated edge configured for receiving the first inflatable wing, a second tube of the two or more elongated inflatable tubes having an elongated inflatable edge configured for receiving the second inflatable wing.

4. The towable aquatic vehicle of claim 1, wherein the one or more elongated inflatable tubes have at least one of: generally cylindrical shape, or generally elliptical cylindrical shape.

5. The towable aquatic vehicle of claim 2, wherein the one or more elongated inflatable tubes form tapered ends.

6. The towable aquatic vehicle of claim 1, further comprising:

a pair of fastening mechanisms respectively disposed on the first and second connection lines, the pair of fastening mechanisms configured for removably securing the first and second inflatable wings to the corresponding sides of the one or more elongated inflatable tubes.

7. The towable aquatic vehicle of claim 4, wherein each fastening mechanism extends along a majority of the full length of the corresponding side of the one or more elongated inflatable tubes.

8. The towable aquatic vehicle of claim 4, wherein each fastening mechanism includes at least one of: a zipper fastening mechanism, a loop connection fastening mechanism, a snap connection fastening mechanism, a Velcro connection fastening mechanism, a buckled connection fastening mechanism, a grommet with rope connection fastening mechanism, or a grommet fastening mechanism.

9. The towable aquatic vehicle of claim 1, wherein the first and second inflatable wings are permanently secured to the corresponding sides of the one or more elongated inflatable tubes.

10. The towable aquatic vehicle of claim 1, further comprising:

at least one handle positioned on the one or more elongated inflatable tubes;

at least one handle positioned on the first inflatable wing; and at least one handle positioned on the second inflatable wing.

11. The towable aquatic vehicle of claim 1, wherein the one or more elongated inflatable tubes are approximately 5 to 10 feet long and approximately 2 to 6 feet wide.

12. The towable aquatic vehicle of claim 1, wherein the width of each of the first and second inflatable wings is between 1.5 and 2 times the width of an elongated inflatable tube of the one or more elongated inflatable tubes.

13. The towable aquatic vehicle of claim 1, wherein the first and second inflatable wings extend along a majority of the full length of the corresponding sides of the one or more elongated inflatable tubes.

14. An inflatable aquatic assembly, comprising:

a first inflatable wing pivotally secured to a first side of a towable aquatic vehicle, wherein the first side defines a first connection line extending along a first elongated outer edge of the towable aquatic vehicle; and a second inflatable wing pivotally secured to a second side of the towable aquatic vehicle, wherein the second side defines a second connection line extending along a second elongated outer edge of the towable aquatic vehicle, the first inflatable wing and the second inflatable wing being positioned opposite with respect to each other.

15. The aquatic assembly of claim 14, wherein the first and second inflatable wings each include at least one fastening mechanism configured for removably securing the first and second inflatable wings to corresponding sides of the towable aquatic vehicle.

16. The aquatic assembly of claim 15, wherein each fastening mechanism includes at least one of: a zipper fastening mechanism, a loop connection fastening mechanism, a snap connection fastening mechanism, a Velcro connection fastening mechanism, a buckled connection fastening mechanism, a grommet with rope connection fastening mechanism, or a grommet fastening mechanism.

17. The aquatic assembly of claim 14, wherein the first and second inflatable wings are permanently secured to corresponding sides of the towable aquatic vehicle.

18. The aquatic assembly of claim 14, wherein each of the first and second inflatable wings extends along a majority of the full length of the corresponding sides of the towable aquatic vehicle.

19. The aquatic assembly of claim 14, further comprising:

at least one handle positioned on the first inflatable wing; and at least one handle positioned on the second inflatable wing.

20. A towable aquatic vehicle, comprising:

one or more elongated inflatable tubes, the one or more elongated inflatable tubes having first and second outer sides, the first outer side defining a first connection line extending along an elongated edge of the first outer side, and the second outer side defining a second connection line extending along an elongated edge of the second outer side;

a first inflatable wing pivotally secured to the first outer side of the one or more elongated inflatable tubes along the first connection line;

a second inflatable wing pivotally secured to the second outer side of the one or more elongated inflatable tubes along the second connection line, the first inflatable wing and the second inflatable wing being positioned opposite with respect to each other;

at least one handle positioned on the one or more elongated inflatable tubes;

at least one handle positioned on the first inflatable wing; and at least one handle positioned on the second inflatable wing.

* * * * *